US011298800B2

(12) United States Patent
Nienaber et al.

(10) Patent No.: US 11,298,800 B2
(45) Date of Patent: Apr. 12, 2022

(54) METHOD OF TRANSFERRING PARTICLES TO A SUBSTRATE

(71) Applicant: 3M INNOVATIVE PROPERTIES COMPANY, St. Paul, MN (US)

(72) Inventors: Aaron K. Nienaber, Maplewood, MN (US); Logan J. Klaers, Vadnais Heights, MN (US); John C. Clark, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1001 days.

(21) Appl. No.: 15/577,068

(22) PCT Filed: Jun. 2, 2016

(86) PCT No.: PCT/US2016/035521
§ 371 (c)(1),
(2) Date: Nov. 27, 2017

(87) PCT Pub. No.: WO2016/196795
PCT Pub. Date: Dec. 8, 2016

(65) Prior Publication Data

US 2018/0085897 A1 Mar. 29, 2018

Related U.S. Application Data

(60) Provisional application No. 62/169,743, filed on Jun. 2, 2015.

(51) Int. Cl.

| | |
|---|---|
| ***B24D 18/00*** | (2006.01) |
| ***B24D 11/00*** | (2006.01) |
| ***B05D 1/28*** | (2006.01) |

(52) U.S. Cl.
CPC ..... *B24D 18/0072* (2013.01); *B05D 1/28* (2013.01); *B24D 11/001* (2013.01); *B24D 11/005* (2013.01); *B05D 2252/02* (2013.01); *B05D 2401/32* (2013.01)

(58) Field of Classification Search
CPC .. B24D 18/00072; B24D 11/005; B05D 1/28; B05D 2252/02; B05D 2401/32
See application file for complete search history.

(56) References Cited

U.S. PATENT DOCUMENTS

| | | | |
|---|---|---|---|
| 4,063,808 A | 12/1977 | Simpson | |
| 4,497,694 A | 2/1985 | Bankier et al. | |
| 4,796,048 A | 1/1989 | Bean | |

(Continued)

FOREIGN PATENT DOCUMENTS

| | | | |
|---|---|---|---|
| DE | 10 2013 212 617 | * 12/2014 | ..... B24D 11/00 |
| DE | 102013212617 | 12/2014 | |

(Continued)

OTHER PUBLICATIONS

International Search Report for PCT/US0216/035521 (dated Aug. 19, 2016) 4 pages.

*Primary Examiner* — Pegah Parvini
(74) *Attorney, Agent, or Firm* — Aleksander Medved

(57) ABSTRACT

An apparatus and method for transferring particles by the use of a transfer tool to at least a portion of which is applied a vacuum to cause particles to jump from a particle source to the transfer tool.

19 Claims, 4 Drawing Sheets

(56) References Cited

U.S. PATENT DOCUMENTS

| | | | | |
|---|---|---|---|---|
| 5,098,871 | A * | 3/1992 | Ray | C04B 35/803 427/443.2 |
| 5,152,917 | A | 10/1992 | Pieper | |
| 5,380,390 | A | 1/1995 | Tselesin | |
| 6,487,002 | B1 | 11/2002 | Biegelsen | |
| 6,833,014 | B2 | 12/2004 | Welygan | |
| 2003/0129302 | A1 | 7/2003 | Chambers | |
| 2007/0227557 | A1* | 10/2007 | Ohlhausen | C09D 183/08 134/4 |
| 2010/0035377 | A1 | 2/2010 | Gobrogge et al. | |
| 2011/0130732 | A1 | 6/2011 | Jackels | |
| 2011/0289854 | A1 | 12/2011 | Moren et al. | |
| 2014/0290147 | A1 | 1/2014 | Seth | |
| 2014/0106126 | A1 | 4/2014 | Gaeta | |
| 2014/0259961 | A1 | 9/2014 | Moren | |
| 2016/0311081 | A1* | 10/2016 | Culler | B24D 3/28 |

FOREIGN PATENT DOCUMENTS

| | | |
|---|---|---|
| WO | WO 95/19242 | 7/1995 |
| WO | WO 2004/011196 | 5/2004 |
| WO | WO 2012/112305 | 8/2012 |
| WO | WO 2015/100018 | 7/2015 |
| WO | WO 2015/100020 | 7/2015 |
| WO | WO 2015/100220 | 7/2015 |

* cited by examiner

METHOD OF TRANSFERRING PARTICLES TO A SUBSTRATE

CROSS REFERENCE TO RELATED APPLICATIONS

This application is a national stage filing under 35 U.S.C. 371 of PCT/US2016/035521, filed Jun. 2, 2016, which claims the benefit of U.S. Provisional Patent Application No. 62/169,743, filed Jun. 2, 2015, the disclosures of which are incorporated by reference in their entirety herein.

BACKGROUND

Substrates comprising particles thereon are often made by depositing the particles, e.g. by drop coating or electrostatic deposition, onto a major surface of the substrate.

SUMMARY

In broad summary, herein is disclosed an apparatus and method for transferring particles by the use of a transfer tool, to at least a portion of which is applied a vacuum to cause particles to jump from a particle source to the transfer tool. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "top", bottom", "upper", lower", "under", "over", "front", "back", "outward", "inward", and "first" and "second" may be used in this disclosure, it should be understood that those terms are used in their relative sense only unless otherwise noted.

Terms such as upward, downward, above, below, and the like, are specifically defined in their conventional sense with respect to the Earth's gravity. For clarity, the vertical direction with respect to the Earth's gravity is depicted in FIGS. 1 and 2 as a "z" axis.

As used herein as a modifier to a property or attribute, the term "generally", unless otherwise specifically defined, means that the property or attribute would be readily recognizable by a person of ordinary skill but without requiring a high degree of approximation (e.g., within +/− 20% for quantifiable properties). The term "substantially", unless otherwise specifically defined, means to a high degree of approximation (e.g., within +/− 10% for quantifiable properties). The term "essentially" means to a very high degree of approximation (e.g., within plus or minus 2% for quantifiable properties); it will be understood that the phrase "at least essentially" subsumes the specific case of an "exact" match. However, even an "exact" match, or any other characterization using terms such as e.g. same, equal, identical, uniform, constant, and the like, will be understood to be within the usual tolerances or measuring error applicable to the particular circumstance rather than requiring absolute precision or a perfect match. All references herein to numerical parameters (dimensions, ratios, and so on) are understood to be calculable (unless otherwise noted) by the use of average values derived from a number of measurements of the parameter, particularly for the case of a parameter that is variable.

DETAILED DESCRIPTION

Figure 1:
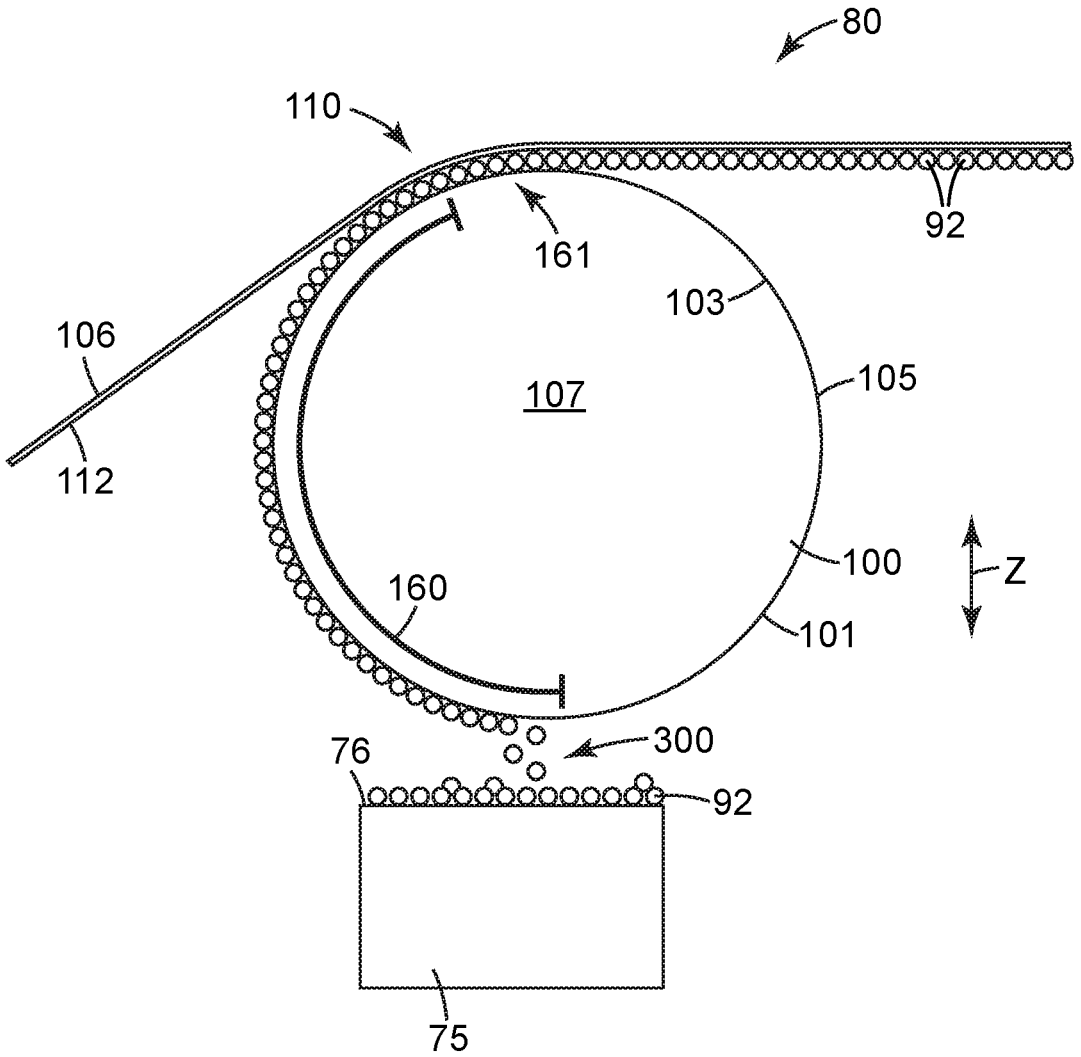
FIG. 1 is a schematic side view of an exemplary apparatus and method for transferring particles to a moving substrate.
Figure 2:
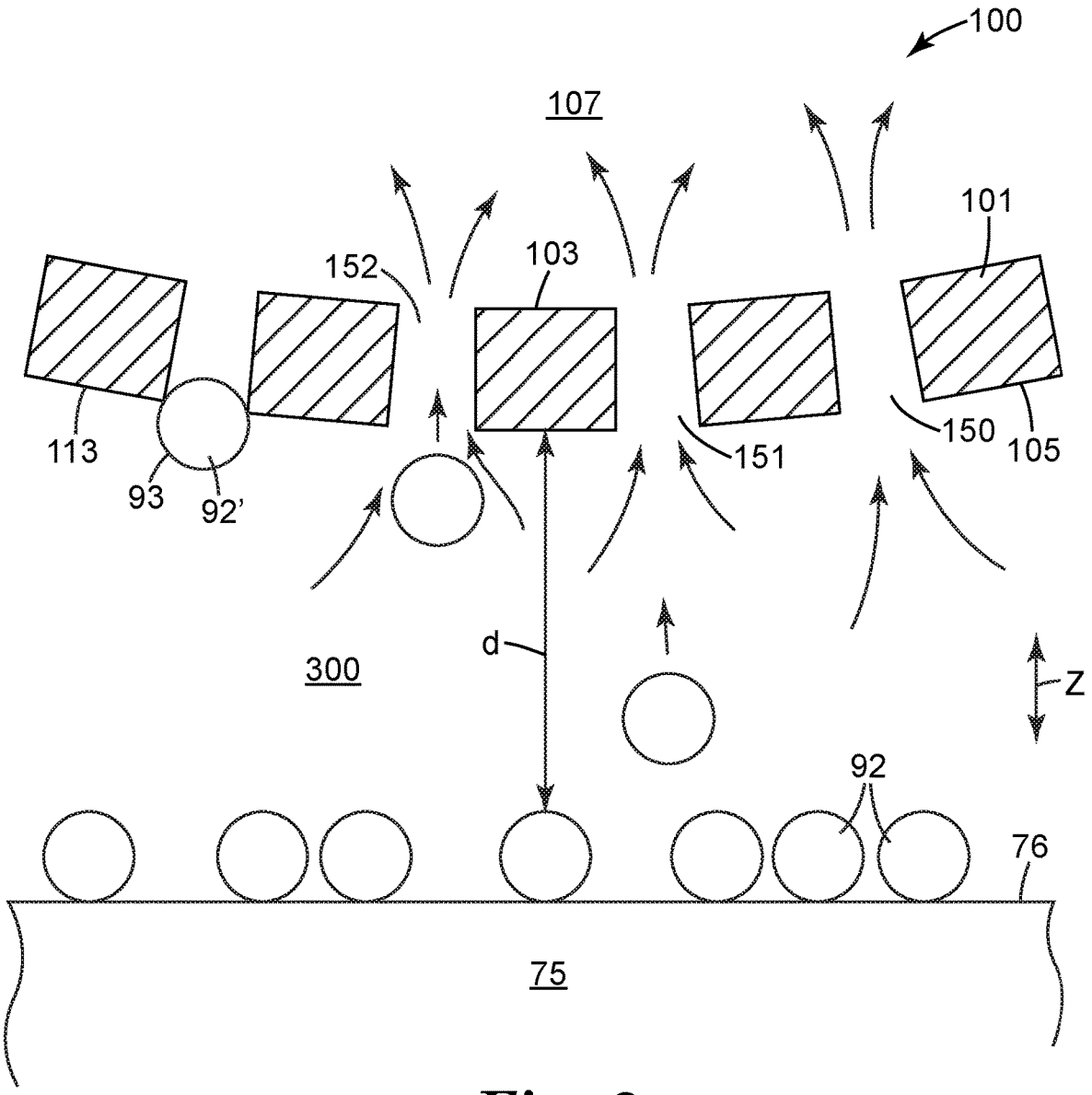
FIG. 2 is a magnified schematic side view of a portion of the apparatus and method of FIG. 1.

Shown in FIG. 1 is an exemplary apparatus 80 and method that can be used to transfer particles 92 onto a major surface 112 of a substrate 106. As shown in further detail in the magnified view of FIG. 2, apparatus 80 includes a transfer tool 100 that comprises a major outer surface layer 101 that possesses a multiplicity of through-holes 150 that each extend from major outer surface 105 of layer 101, to major inner surface 103 of layer 101, so that air can flow inward (toward the interior of tool 100) through the through-hole (unless plugged by a particle as described later). In the illustrated embodiment of FIGS. 1 and 2, transfer tool 100 is a roll with a major outer surface layer (shell) 101 comprising through-holes 150 and with an interior 107 that is hollow at least to the extent of allowing a vacuum to be applied to at least a portion of shell 101 from the interior of roll 100. As depicted in exemplary embodiment in FIG. 1, a vacuum source (not shown) is used to apply a vacuum to at least a first portion 160 of the path that major outer surface layer 101 of transfer tool (roll) 100 follows as the transfer tool moves (rotates, in this case). As shown in magnified detail in FIG. 2, the vacuum source is used to develop a vacuum within at least a portion of hollow interior 107 of roll 100 so that air that is outside roll 100 (e.g., that is in the gap 300 between the roll and the below-described particle source 75) is sucked inwardly (toward the interior of roll 100) through the through-holes 150 of shell 101, as indicated by the curved arrows in FIG. 2.

Particle-transfer apparatus 80 also includes a particle source 75, which may comprise any convenient surface with particles 92 thereon, in loose form (that is, the particles are not bonded to each other, nor are they bonded to upward major surface 76 of particle source 75 or to any portion of particle source 75). In some embodiments, the particles 92 may be present on major surface 76 of particle source 75 at least generally, substantially, or essentially as a monolayer of particles (notwithstanding occasional places where particles may be stacked e.g. in two layers (two such occurrences are depicted in FIG. 1)). However, this may not be strictly necessary, and in some embodiments the particles may be provided on major surface 76 in an arrangement that may be two, three, four, five or even more layers deep, on average over the area of major surface 76. The particles may be provided, e.g. deposited, on major surface 76 by any suitable means, (e.g. via a screw conveyor, conveyor belt, etc.). The particles may be deposited on major surface 76 in a continuous manner, or batchwise. If desired, at least major surface 76 of particle source 75 may be vibrated or otherwise agitated to assist in spreading particles 92 over major surface 76 in a uniform manner.

Particle source 75 may be of any suitable design. Typically it will be at least as wide (in the crossweb direction) as transfer tool 100 so as to supply particles across the entire width of the transfer tool. It may comprise a generally flat surface (e.g. as shown in FIG. 1) or it may e.g. be slightly arcuate e.g. to at least generally match any curvature of the transfer tool (e.g. in the case that the transfer tool is a roll). Whatever the particular design, particle source 75 will be positioned sufficiently far below transfer tool 100, and particles will be deposited on major surface 76 of particle source 75, that the outer surface 105 of transfer tool 100 does not contact particles that are supported on surface 76 of particle source 75.

In fact, particle source 75 (specifically, upward major surface 76 thereof and in particular the particles that are on surface 76) and transfer tool 100 are positioned relative to each other so that a gap 300 (an air gap) exists therebetween as shown in FIG. 2. This gap is defined by the distance of closest approach between abrasive particles that are present on major surface 76, and major outer surface 105 of transfer tool 100, and in some embodiments is at least about 0.2 mm. (An exemplary distance of closest approach "d" is shown in FIG. 2). This distance of closest approach may often, but does not necessarily have to, exactly follow the vertical axis "z" established by the Earth's gravity. In various embodiments, this distance of closest approach that characterizes gap 300, may be at least about 0.3, 0.4, 0.5, 0.6, 0.7, 0.8, 0.9, or 1.0 mm, or even as much as 0.3, 0.4, 0.5, 0.6, 0.7, 0.8, 0.9, 1.5, or 2.0 cm.

In some embodiments, the distance of closest approach that characterizes gap 300 may be defined relative to the average diameter (or equivalent diameter, in the case of non-spherical particles) of the particles. In various embodiments, the distance of closest approach may be at least about 2 times, 3 times, 4 times, 5 times, 8 times, 10 times, or 20 times, the average diameter. (By way of specific example, for particles with an average diameter of 100 μm, a distance of closest approach between major outer surface 105 of transfer tool 100, and the (nearest portion of) particles that was 3 times the particle diameter would be a distance of 300 microns.)

It will be appreciated that in order to travel from major surface 76 of particle source 75 to outer surface layer 101 of transfer tool 100, particles 92 must move at least generally vertically upward against the pull of the Earth's gravity (or, they must move e.g. generally horizontally without being deflected downward by the Earth's gravity to the extent that they are misdirected). It has been unexpectedly found that the application of vacuum as described above can cause particles 92 to "jump" e.g. upward from major surface 76, to travel e.g. upward through the air gap 300 (as denoted by the straight arrows in FIG. 2), and to impinge against (i.e., land on) the outer ends 151 of through-holes 150 of transfer tool 100. In fact, using such apparatus and methods, particles have been able to jump a distance, e.g. a vertical distance, of at least 1.0 cm, and even up to about 2.5 cm. Moreover, it has been found that as more and more particles jump the gap and impinge on the outer ends 151 of through-holes 150, they at least partially block the airflow through the through-holes and cause the upward suction force within gap 300 to diminish. Thus, the particle-transfer process has unexpectedly been found to be self-limiting—that is, it can cause particles to impinge on, and reside upon, at least substantially all of the through-holes 150 of transfer toll 100 without causing excess particles to land on major surface 105 of the transfer tool. This process thus may avoid the need to remove excess particles from the surface of a transfer tool, in contrast to many conventional transfer processes which often must use e.g. brushes, air knives, or the like to remove excess particles. Moreover, the disclosed apparatus and method can cause particles to be deposited singly upon each through-hole (meaning that only one particle resides upon each through-hole).

The ordinary artisan will readily understand that the arrangements disclosed herein, relying on a gap between the outer surface of the transfer tool and the particles to be transferred thereto, is distinguished from designs in which no such gap exists. The artisan will appreciate that U.S. Pat. No. 6,487,002 to Biegelsen is one example of a design in which no gap as defined and described herein, exists.

While the exemplary designs of FIGS. 1 and 2 show particles that are transferred along a direction that is essentially vertical (with respect to the Earth's gravity); this is not strictly necessary; in some embodiments the transfer may occur at least generally along a horizontal direction either in combination with, or instead of, the transfer occurring at least somewhat along a vertical direction.

In further detail, with reference to FIG. 1, in some embodiments layer 101 of transfer tool 100 may travel along a first portion 160 of the tool path, along which portion of the tool path a vacuum may be applied to the inward face 103 of major outer surface layer 105. In this manner, particles may be transferred from particle source 75 and impinge on, and be held against, through-holes 150 as the roll travels along this first portion of the tool path. Layer 101 of transfer tool 100 may further travel along a second portion 161 of the tool path, along which portion a lesser (weaker) vacuum, no vacuum, or even a positive pressure (from within the interior of roll 100) may be applied in order to dislodge the particles 92 from the through-holes 150. Thus in some embodiments, transfer roll 100 may be plumbed, and/or may comprise internal dividers, such that a vacuum can be applied along a first portion of the path of the transfer tool (e.g., along a specific arc segment of the path), while no vacuum, or even pressurized air, can be applied along a second portion of the path of the transfer tool to assist in dislodging the particles from the through-holes. In such embodiments, the leading (up-path) edge of second portion 161 of the tool path may advantageously be positioned near the location 110 where moving substrate 106 comes into close proximity to tool roll 100 (as shown in FIG. 1) to facilitate transferring particles 92 from tool roll 100 to substrate 106.

In alternative embodiments, a vacuum may be applied to at least substantially the entire radially inward face 103 of roll 100, along the entire tool path. In such a case, a force may be applied to the particles that is greater than the vacuum holding force, in order to dislodge the particles from the through-holes and transfer them to the substrate. One example of such an arrangement might rely on a substrate 106 in which a pressure-sensitive adhesive provides major particle-receiving surface 112 thereof, in which the adhesive is brought into contact with the protruding portion 93 of particles 92 and the particles adhere to the adhesive sufficiently strongly that they remain attached to the adhesive and are thus removed from the through-holes.

Figure 3:
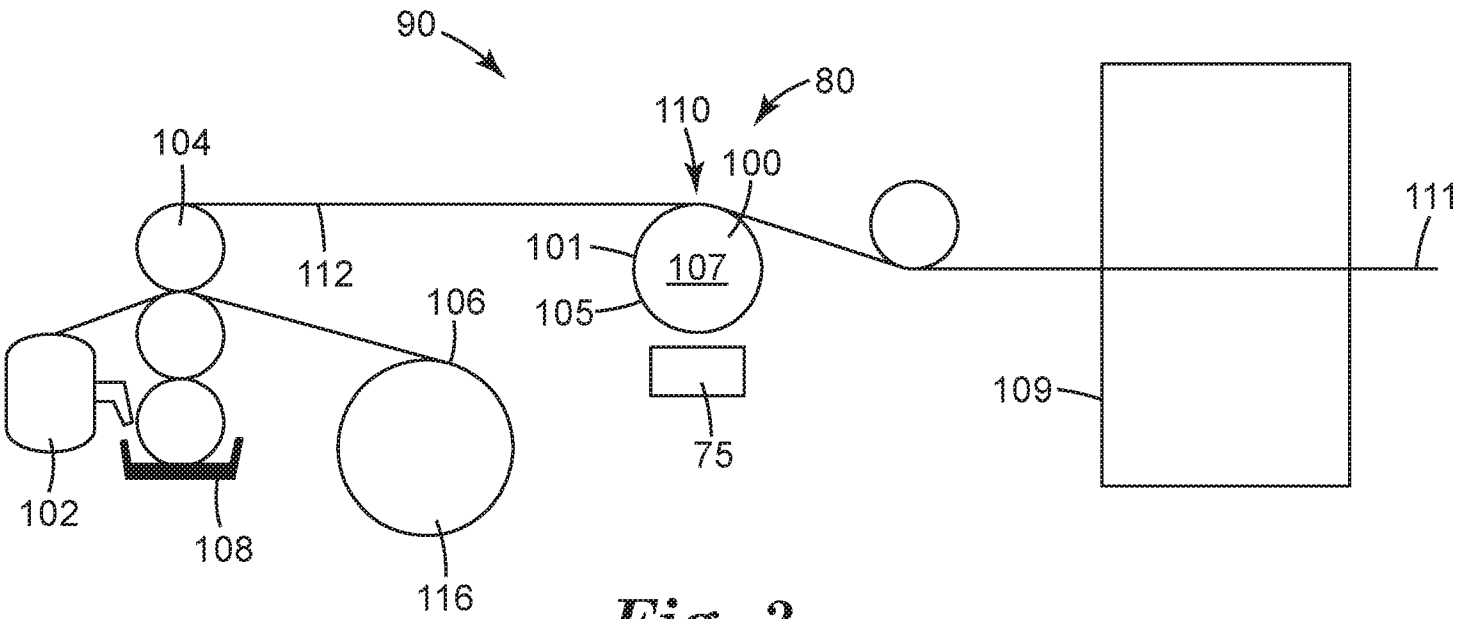
FIG. 3 is a schematic side view of an exemplary apparatus and method for producing a substrate with particles bonded to a major surface thereof, using the apparatus of FIGS. 1 and 2.

Referring now to FIG. 3, the above-described transfer apparatus 80 may be used as part of an apparatus 90 for producing a particle-bearing substrate 111. Such an apparatus may include e.g. an unwind 116 for supplying substrate 106, and a delivery system 102 and applicator 104 for disposing (e.g., coating) a material 108 to form a particle-adherent layer (e.g. in the form of a surface coating of suitable material) on major surface 112 of substrate 106. It is emphasized however that any substrate 106 with any suitable particle-adherent major surface 112 may be used; such a particle-adherent surface does not necessarily have to be achieved by way of a coating a separate layer onto the substrate. For example, a major surface 112 of substrate 106 (or indeed, a considerable thickness of the substrate, or even the entire substrate) might be made of a material that can be sufficiently softened (e.g., by heating) so as to be particle-adherent. At least major surface 112 of such a substrate may then be heated prior to the substrate being brought into proximity to transfer tool 100 so that particles can be transferred onto the softened, particle-adherent surface 112 of the substrate. (As used herein, "proximity" signifies a distance of less than about 0.5 cm, and includes actual contact.)

Regardless of the specific nature and composition of substrate 106, substrate 106 follows a web path to a location 110 (shown most clearly in FIG. 1) at which it closely approaches the outer surface 105 of transfer tool 100. At this location, particles 92 may be transferred from tool 100 to particle-adherent major surface 112 of substrate 106, by any suitable method. For example, particle-adherent major surface 112 of substrate 106 may be brought into direct contact with portions 93 of particles 92 that protrude outwardly from through-holes 150. The particles may then remain with substrate 106 as the substrate and the transfer tool eventually diverge along their separate paths. In other embodiments, a small gap may exist between particle-adherent major surface 112 of substrate 106, and particles 92, with e.g. a positive pressure being applied to the interior of transfer tool 100 to dislodge the particles from the through-holes and motivate them across the gap and onto the particle-adherent major surface 112. In still other embodiments, gravity may be used to assist in dislodging particles from the through-holes. For example, in the exemplary design of FIG. 1, substrate 106 might wrap further around tool roll 100 in a clockwise direction, so that substrate 106 does not diverge from tool roll 100 until it reaches the lower-right quadrant of the tool roll path, at which location at least some assistance from gravity may help to dislodge the particles. Thus in general, substrate 106 may approach transfer roll 100 at any desired angle of incidence and may follow the surface of the transfer roll for any desired wrap angle. In various embodiments, the substrate may follow the transfer roll at a wrap angle of e.g. between 10 and 90 degrees.

It will be appreciated that any suitable combination of the above methods may be used in order to transfer the particles to the substrate. After the transfer of particles occurs, substrate 106 may e.g. be passed through an oven 109 (or any suitable device that imparts a thermal exposure) to fully harden the particle-adherent material of surface 112 of substrate 106 so as to securely bind the particles 92 thereto to form particle-bearing substrate 111. Or, if surface 112 included a material that had been heated to be softened so as to be particle-adherent, substrate 106 may be passed through a cooling device (which may be passive or active) to cool the material so that it hardens. Again, there are many ways in which the securing of particles to surface 112 can be done; for example a particle-adherent surface may be e.g. a photocurable or e-beam curable composition, in which case a suitable curing device can be used instead of, or in addition to, a thermal exposure. Whatever the specific arrangements, the transfer tool 100 precisely transfers and positions each particle 92 onto the particle-adherent surface 112 of substrate 106, substantially reproducing the pattern of particles as present on the surface of the transfer tool, to form particle-bearing substrate 111. Particle-bearing substrate 111 may then be e.g. wound, sheeted, converted, packaged, and so on, as desired.

Substrate 106 may be any suitable material, as long as it exhibits a particle-adherent surface 112 or can have such a particle adherent-surface 112 imparted thereto (whether by coating an additional layer on the substrate, by surface-treating the substrate, by heating the substrate, and so on). Substrate 106 may be made of a single layer or may comprise multiple layers of material. In various embodiments, substrate 106 can be a cloth, paper, film, nonwoven, scrim, or other web substrate. If a particle-adherent layer (e.g., a coating) is used to provide particle-adherent surface 112 of receiving substrate, the layer may be of any suitable composition. For example, such a coating may be a "make coat" as is commonly referred to in the abrasive arts. Such a make coat may be e.g. a phenolic resin or any of the other make coat compositions that are known. A make coat applicator 104 can be, for example, a coater, a roll coater, a spray system, or a rod coater.

In at least some embodiments, apparatus 90 does not include any kind of device or mechanism for assisting in moving the particles on major surface 105 of tool 100 so that they become seated onto a through-hole. (Rather, the applied vacuum will typically directly impinge and seat each particle onto a through-hole, as described above.) In such embodiments, no filling-assist device such as e.g. a doctor blade, a felt wiper, a brush having a plurality of bristles, a vibration system, a blower or air knife, may be present. In at least some embodiments, apparatus 90 does not include any kind of device or mechanism for removing excess particles (i.e., particles that are not seated in through-holes of transfer tool 100) from the surface 105 of transfer tool 100. In such embodiments, no such device as e.g. a doctor blade, a felt wiper, a brush having a plurality of bristles, a scraper, a vibration system, a blower or air knife, may be present.

Outward major surface layer 101 of transfer tool 100 will comprise a multiplicity of through-holes 150 as noted. Such through-holes, and particularly the outward openings 151 thereof, may have any desired shape, regular or irregular, such as, for example, a rectangle, semi-circle, circle, triangle, square, hexagon, or octagon. The through-holes can be straight or can be tapered (e.g., with the largest opening facing the air gap, as shown in the exemplary design of FIG. 2). The pattern formed by the through-holes can be arranged according to a specified plan or can be random (however, this will still result in the particles being transferred to the substrate in a manner that is pre-determined by the pattern of through-holes of the transfer tool, even though the pattern itself may be random). If the through-holes are provided in a regular array, any suitable arrangement may be used (e.g., as square array, a hex array, and so on). Any suitable through-hole spacing may be used. For example, in various embodiments the through-holes may be arranged at an average center-to-center spacing of at least about 50, 100, 150, 200, or 250 microns. In further embodiments the through-holes may be arranged at an average center-to-center distance of at most about 500, 400, 300, 250, 200, 150, 100, or 75 microns. In some embodiments the through-holes may be arranged at a center-to-center spacing that is relatively small compared to the diameter of particles 92 (or equivalent diameter in the case of non-spherical or irregular-shaped particles). This may allow the particles to be transferred to the transfer tool (and from there to the substrate) at a high area density of particles per unit area. In various embodiments, the average center-to-center spacing of the through-holes may be no more than about 4.0, 3.0, 2.0, 1.8, 1.6, 1.5, 1.4, 1.3, or 1.2 times the average diameter or equivalent diameter of particles 92.

The through-holes may have any shape and diameter (or equivalent diameter in the case of non-circular holes), and are typically selected depending on the specific application. In various embodiments, the through-holes may have a diameter or equivalent diameter, at the outer end 151 of the through-hole, of at least about 20, 50, 100, or 150 microns. In further embodiments, the through-holes may have a diameter or equivalent diameter, at the outer end 151 of the through-hole, of at most about 500, 400, 300, 250, 200, 150, or 100 microns.

Figure 4:
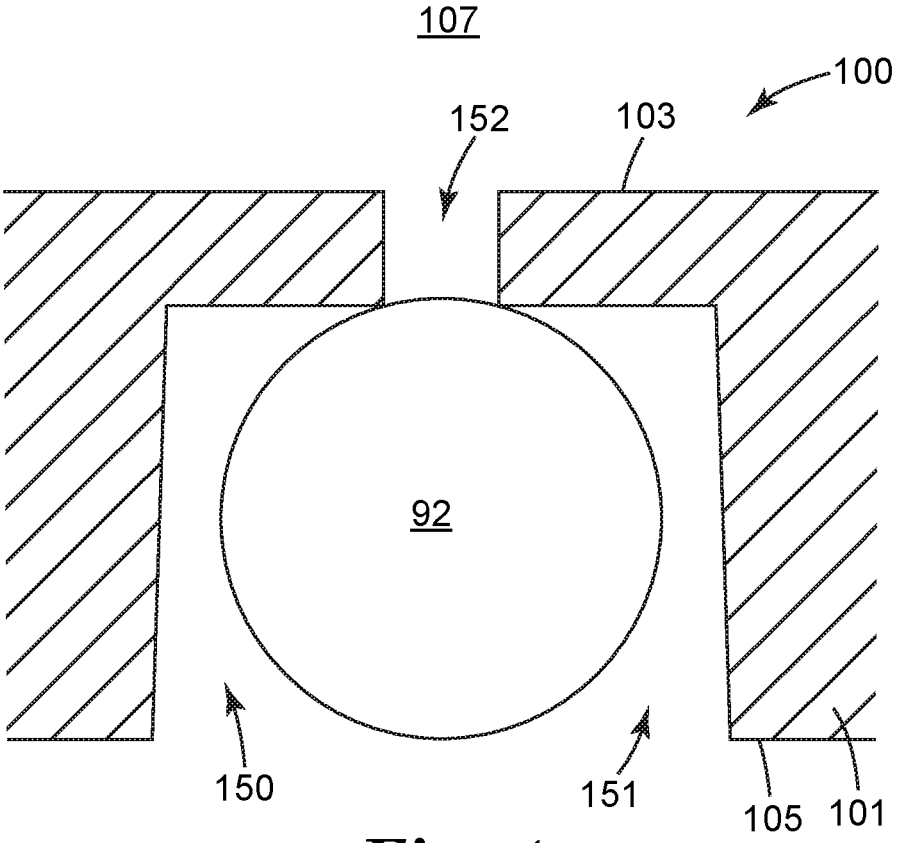
FIG. 4 is a schematic side view of an exemplary through-hole of a transfer tool.

In some embodiments, the through-holes may be cylindrical or conical. In some embodiments, at least a portion (and more preferably a majority, or even all) of the through-holes are shaped (i.e., individually intentionally engineered to have a specific shape and size), and more preferably are precisely-shaped. In some embodiments, the through-holes have smooth walls and sharp angles formed by a molding process and having an inverse surface topography to that of a master tool (e.g., a diamond turned metal master tool roll) in contact with which it was formed. One such type of through-hole that may be formed in such a manner is depicted in exemplary embodiment in FIG. 4. In other embodiments, the through-holes may be formed by an etching process.

The through-holes comprise at least one sidewall; typically the through-hole shape is defined by the sidewalls. In some preferred embodiments, the through-holes have at least 3, at least 4, at least 5, at least 6, at least 7, or at least 8 sidewalls. A conical, cylindrical, or oval-shaped through-hole may be considered as having only a single, continuous sidewall. The sidewalls are preferably smooth, although this is not a requirement. The sidewalls may be planar, curviplanar (e.g., concave or convex), conical, or frustoconical, for example.

In some embodiments (as depicted in exemplary manner in FIG. 1), particles 92 may not reside completely within through-holes 150, but rather may have a protruding portion 93 that protrudes outwardly beyond portions 113 of a major outer surface 105 of the major outer surface layer 101 of the transfer tool that are adjacent to the through-hole. (This is illustrated in exemplary manner in FIG. 1 by way of particle 92' exhibiting a protruding portion 93.) In other embodiments, particles 92 may reside completely within at least portions of through-holes 150, as shown in exemplary embodiment in FIG. 4.

In some embodiments, through-holes 150 may be shaped and sized, and particles 92 may be shaped and sized, so that each particle at least essentially blocks the airflow through the through-hole (i.e., it occludes, or in other words plugs up, the through-hole) when the particle is seated upon the through-hole. An example of this might be through-holes with a cylindrical (or conical) geometry and circular outer openings 151, used in combination with particles that are spherical (e.g., a design of the general type shown in FIG. 2). In other embodiments, through-holes 150 may be shaped and sized, and particles 92 may be shaped and sized, so that each particle does not fully occlude or plug the through-hole, i.e., it does not completely block the airflow through the through-hole. As evidenced in the Representative Working Example herein, performance has still been found to be satisfactory (in causing particles to jump across the gap onto the transfer tool, and for the process to be self-metering as described above) even in the absence of full occlusion. By way of specific example, the Representative Working Example used spherical particles in combination with through-holes that were hexagonal in cross-sectional shape, so that the particles did not fully block the holes when seated thereon. In various embodiments, each particle may occlude from about e.g. 60, 70, or 80% of the area of the through-hole into which the particle is seated, to about 98, 95, 90, or 85% of the area of the through-hole.

Particles 92 can be any particles that are desired to be deposited and secured (bonded) to the surface of a substrate. In some embodiments, particles 92 are microspheres. Microspheres can be made from a variety of materials, such as glass, polymers, glass ceramics, ceramics, metals and combinations thereof. In some embodiments, the microspheres are glass beads. The glass beads are largely spherically shaped. The glass beads are typically made by grinding ordinary soda-lime glass or borosilicate glass, typically from recycled sources such as from glazing and/or glassware. Common industrial glasses could be of varying refractive indices depending on their composition. Soda lime silicates and borosilicates are some of the common types of glasses. Borosilicate glasses typically contain boria and silica along with other elemental oxides such as alkali metal oxides, alumina etc. Some glasses used in the industry that contain boria and silica among other oxides include E glass, and glass available under the trade designation "NEXTERION GLASS D" from Schott Industries, Kansas City, Mo., and glass available under the trade designation "PYREX" from Corning Incorporated, New York, N.Y.

The grinding process typically yields a wide distribution of glass particle sizes. The glass particles may be spherodized by treating in a heated column to melt the glass into spherical droplets, which are subsequently cooled. Not all the beads are perfect spheres. Some are oblate, some are melted together and some contain small bubbles. In some embodiments, glass microspheres may be substantially, or essentially, free of defects. As used herein, the phrase "free of defects" means that the microspheres have low amounts of bubbles, low amounts of irregular shaped particles, low surface roughness, low amount of inhomogeneities, low amounts undesirable color or tint, or low amounts of other scattering centers.

The microspheres may be sized e.g. via screen sieves to provide a useful distribution of particle sizes. In some embodiments, a useful range of average microsphere diameters is about 5 μm to about 200 μm (e.g., about 35 to about 140 μm, about 35 to 90 μm, or about 38 to about 75 μm).

If the particles 92 are abrasive particles, they should have sufficient hardness and surface roughness to function as abrasive particles in abrading processes. Preferably, the abrasive particles have a Mohs hardness of at least 4, at least 5, at least 6, at least 7, or even at least 8. Exemplary abrasive particles include crushed, shaped abrasive particles (e.g., shaped ceramic abrasive particles or shaped abrasive composite particles), and combinations thereof.

Examples of suitable abrasive particles include: fused aluminum oxide; heat-treated aluminum oxide; white fused aluminum oxide; ceramic aluminum oxide materials such as those commercially available under the trade designation 3M CERAMIC ABRASIVE GRAIN from 3M Company, St. Paul, Minn.; brown aluminum oxide; blue aluminum oxide; silicon carbide (including green silicon carbide); titanium diboride; boron carbide; tungsten carbide; garnet; titanium carbide; diamond; cubic boron nitride; garnet; fused alumina zirconia; iron oxide; chromia; zirconia; titania; tin oxide; quartz; feldspar; flint; emery; sol-gel-derived abrasive particles (e.g., including shaped and crushed forms); and combinations thereof. Further examples include shaped abrasive composites of abrasive particles in a binder matrix, such as those described in U.S. Pat. No. 5,152,917 (Pieper et al.). Many such abrasive particles, agglomerates, and composites are known in the art. Many other potentially suitable abrasive particles are described in U.S. Provisional Patent Application No. 61/919,992, filed Dec. 23, 2014 and entitled METHOD OF MAKING A COATED ABRASIVE ARTICLE, which is incorporated by reference herein. Whatever their specific nature, in various embodiments particles 92 may be made of a material that has an inherent density of at least about 2.0, 2.2, or 2.4 grams per cubic meter.

Although described above in the exemplary embodiment in which the transfer tool is a roll, in some embodiments the transfer tool can be in the form of, for example, an endless belt.

LIST OF EXEMPLARY EMBODIMENTS

Embodiment 1 is a method of transferring particles onto a moving substrate, the method comprising: providing a moving transfer tool that travels along an endless tool path and that comprises a major outer surface layer comprising a multiplicity of through-holes in a pre-determined pattern, providing a particle source surface comprising loose particles thereon, wherein the particle source surface is positioned proximate a first portion of the tool path so that in the first portion of the tool path there is a gap between the major outer surface layer of the transfer tool and the loose particles on the particle source surface, the gap being at least 0.2 mm at the point of closest approach between the major outer surface of the transfer tool and the loose particles on the particle source surface; moving the transfer tool along the tool path so that as a section of the transfer tool traverses the first portion of the tool path, a vacuum applied to the section of the transfer tool in the first portion of the tool path causes at least some particles of the loose particles to traverse the gap between the particle source surface and the major outer surface layer of the transfer tool and causes individual particles to be deposited singly upon through-holes of the multiplicity of through-holes of the transfer tool; and, moving the transfer tool further along the tool path so that as the section of the transfer tool bearing particles upon the through-holes thereof enters a second portion of the tool path, the particles are each dislodged from each through-hole and are transferred onto a particle-adherent surface of a moving substrate that is in proximity with the moving transfer tool in the second portion of the tool path, wherein the particles are transferred onto the moving substrate in a pre-determined pattern established by the pre-determined pattern of the multiplicity of through-holes in the major outer surface layer of the transfer tool.

Embodiment 2 is the method of embodiment 1 wherein each particle that is deposited upon a through-hole exhibits an outward-facing portion that protrudes outwardly beyond portions of a major outer surface of the major outer surface layer of the transfer tool that are adjacent to the through-hole. Embodiment 3 is the method of embodiment 2 wherein the method comprises bringing the particle-adherent major surface of the moving substrate into contact with at least a section of a surface of the outward-facing portion of each particle so that the particles are adhered to the moving substrate and are removed from the moving transfer tool as the moving substrate and the transfer tool move and diverge from each other.

Embodiment 4 is the method of any of embodiments 1-3 wherein a vacuum is not applied to the moving transfer tool as the tool traverses the second portion of the tool path. Embodiment 5 is the method of any of embodiments 1-4 wherein positive pressure is applied to the moving transfer tool as the tool traverses the second portion of the tool path, to assist in dislodging the particles from the through-holes. Embodiment 6 is the method of any of embodiments 1-3 wherein a vacuum is applied to the moving transfer tool throughout the entirety of the tool path of the moving transfer tool.

Embodiment 7 is the method of any of embodiments 1 and 4-6 wherein each particle that is deposited upon a through-hole, resides completely within the through-hole so that no portion of the particle exhibits an outward-facing portion that protrudes outwardly beyond portions of a major outer surface of the major outer surface layer of the transfer tool that are adjacent to the through-hole. Embodiment 8 is the method of any of embodiments 1-7 wherein the through-holes are shaped and sized and the particles are shaped and sized so that each particle does not fully occlude a through-hole into which it is deposited. Embodiment 9 is the method of any of embodiments 1-7 wherein through-holes are shaped and sized and the particles are shaped and sized so that each particle does fully occlude a through-hole into which it is deposited.

Embodiment 10 is the method of any of embodiments 1-9 wherein a gap of at least about 1.0 cm is present at the point of closest approach of the major outer surface of the transfer tool and the loose particles on the particle source surface. Embodiment 11 is the method of any of embodiments 1-10 wherein the through-holes are provided in a regular array with an average center-to-center spacing of the through-holes of less than about 200 microns. Embodiment 12 is the method of any of embodiments 1-11 wherein the particles are spherical particles with an average diameter and wherein through-holes are provided in a regular array with an average center-to-center spacing of the through-holes that is less than about 1.4 times the average diameter of the spherical particles.

Embodiment 13 is the method any of embodiments 1-12 wherein the moving transfer tool is an endless belt. Embodiment 14 is the method of any of embodiments 1-12 wherein the moving transfer tool is a roll. Embodiment 15 is the method of any of embodiments 1-11 and 13-14 wherein the loose particles are at least generally spherical. Embodiment 16 is the method of any of embodiments 1-15 wherein the loose particles are made of a material with an inherent density of at least about 2.0 grams/cc. Embodiment 17 is the method of any of embodiments 1-16 wherein the loose particles are glass microspheres. Embodiment 18 is the method of any of embodiments 1-16 wherein the loose particles are abrasive particles.

EXAMPLES

Representative Working Example

A metal plate was etched to provide a hexagonal array of hexagonal-shaped through-holes. This etched metal plate was wrapped onto the outer surface of a vacuum-enabled roll to form a transfer tool (in this case, a roll). The vacuum-enabled roll was composed of a mounting frame, shaft, shell, and various screen layers throughout the shell. The shaft was composed of 3" outer diameter hollow aluminum with a simple shop vacuum applied directly to one end while the opposing end was plugged. Mounted on the shaft was a 5" diameter roller at 4" width. Within the 4" width, holes were drilled on the outer surface of the shaft to allow the shop vacuum to pull a negative pressure in the space provided between the shell and the outer surface of the shaft.

The shell of the transfer tool (roll) was composed of several layers. The innermost layer was composed of a screen with a 3/16" diameter staggered hole pattern with 40% open area. This layer was 0.045" thick and was shaped into a shell with a sheet metal slip roll machine. The next layer of the shell was a thin nonwoven substrate (a wipe) so as to provide a means of uniformly distributing vacuum. The outermost layer of the shell was composed of the above-mentioned etched metal plate (a stainless steel plate of 0.004 inches thickness) with a staggered hexagon shaped hole pattern with a 170 micrometer hole width at the narrowest portion and a spacing of 500 micrometers between the centers of the hexagon shaped holes. The purpose of the multiple inward layers of the roll shell was to provide a uniform vacuum distribution to the outermost, etched layer bearing the desired through-hole pattern. In this prototype setup, vacuum was applied to the entirety of the transfer roll rather than being applied to only a portion of the roll.

A particle source was positioned below the transfer roll. This assembly was placed within a web handling system such that the incoming web wrapped the transfer roll beginning from top dead center and extending approximately 70 degrees in the web direction around the roll before releasing. The surface of the particle source beneath the transfer roll supplied a bed of nominally spherical glass beads that were approximately 200 micrometers in average diameter. The particle bed was placed on top of an adjustable height table to easily adjust the gap between the particle bed and the transfer roll. Additionally, an electromagnetic vibrator was used to provide a more continuous layer of particles directly underneath the vacuum transfer roll.

Once vacuum was applied to the interior of the transfer roll, the web system was turned on to provide a rotation to the roller at a line speed of approximately 13 cm per minute. As the roller was turning, the particle bed gap was reduced until particles would begin to jump upward across the gap between the surface of the particle source and the outer surface of the transfer roll. This gap was optimized at approximately 0.64 cm with 25 inches of water pressure drop provided through the shell of the roller. Particles jumped directly to the hexagon shaped holes until the through-holes were sufficiently occupied by particles. Since the particles were too large to fit entirely into the interior of the through-holes each particle impinged on, and was seated onto, a through-hole in the general manner shown for particle 92' of FIG. 2.

Since the through-hole geometry was a hexagon and the particles were nominally spherical, the particles when seated onto the through-holes did not completely occlude the through-holes. However, as more and more particles accumulated in through-holes and partially occluded each through-hole, there was no longer sufficient vacuum for particles to jump through the gap. Thus very few or no particles jumped the gap to land on the surface of the transfer roll in a location other than on a through-hole.

As the transfer roll continued to turn, a web (a vinyl tape) that had a pressure-sensitive adhesive coating on one major surface thereof was brought into close proximity to the roll so that the adhesive surface of the tape contacted the protruding portions of the particles. The adhesion from this web was sufficient to dislodge the particles from the through-holes, overcoming the retaining force applied by the vacuum. As the adhesive web diverged from the tooling, the particles remained on the adhesive web, in a precisely patterned spacing as defined by the hexagonal array of through-holes on the transfer roll.

Variation Examples

Other experiments were done using the above setup. Also, some experiments were done using a transfer roll with a microreplicated outer layer which comprised through-holes of the general type depicted in FIG. 4. In these experiments (with glass particles of nominal diameter about 65 microns), the glass particles fit at least almost entirely into the through-holes in the general manner shown in FIG. 4. A substrate (the same vinyl tape as described above) was nevertheless, when brought into contact with the transfer roll, able to remove the particles from the transfer roll in similar manner as described above.

The foregoing Examples have been provided for clarity of understanding only, and no unnecessary limitations are to be understood therefrom. The tests and test results described in the Examples are intended to be illustrative rather than predictive, and variations in the testing procedure can be expected to yield different results. All quantitative values in the Examples are understood to be approximate in view of the commonly known tolerances involved in the procedures used.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). To the extent that there is any conflict or discrepancy between this specification as written and the disclosure in any document incorporated by reference herein, this specification as written will control.

What is claimed is:

1. A method of transferring particles onto a moving substrate, the method comprising:

providing a moving transfer tool that travels along an endless tool path and that comprises a major outer surface layer comprising a multiplicity of through-holes in a pre-determined pattern, providing a particle source surface comprising loose particles thereon, wherein the particle source surface is positioned below the transfer tool and proximate a first portion of the tool path so that in the first portion of the tool path there is a gap between the major outer surface layer of the transfer tool and the loose particles on the particle source surface, the gap being at least 0.2 mm at the point of closest approach between the major outer surface of the transfer tool and the loose particles on the particle source surface;

moving the transfer tool along the tool path so that as a section of the transfer tool traverses the first portion of the tool path, a vacuum applied to the section of the transfer tool in the first portion of the tool path causes at least some particles of the loose particles to traverse, generally vertically against the pull of gravity, the gap between the particle source surface and the major outer surface layer of the transfer tool and causes individual particles to be deposited singly upon through-holes of the multiplicity of through-holes of the transfer tool; wherein each particle that is deposited upon a through-hole exhibits an outward-facing portion that protrudes outwardly beyond portions of a major outer surface of the major outer surface layer of the transfer tool that are adjacent to the through-hole; and, moving the transfer tool further along the tool path so that as the section of the transfer tool bearing particles upon the through-holes thereof enters a second portion of the tool path, the particles are each dislodged from each through-hole and are transferred onto a particle-adherent surface of a moving substrate that is in proximity with the moving transfer tool in the second portion of the tool path, wherein the particles are transferred onto the moving substrate in a pre-determined pattern established by the pre-determined pattern of the multiplicity of through-holes in the major outer surface layer of the transfer tool.

2. The method of claim 1 wherein the method comprises bringing the particle-adherent major surface of the moving substrate into contact with at least a section of a surface of the outward-facing portion of each particle so that the particles are adhered to the moving substrate and are removed from the moving transfer tool as the moving substrate and the transfer tool move and diverge from each other.

3. The method of claim 1 wherein a vacuum is not applied to the moving transfer tool as the tool traverses the second portion of the tool path.

4. The method of claim 1 wherein positive pressure is applied to the moving transfer tool as the tool traverses the second portion of the tool path, to assist in dislodging the particles from the through-holes.

5. The method of claim 1 wherein a vacuum is applied to the moving transfer tool throughout the entirety of the tool path of the moving transfer tool.

6. The method of claim 1 wherein each particle that is deposited upon a through-hole, resides completely within the through-hole so that no portion of the particle exhibits an outward-facing portion that protrudes outwardly beyond portions of a major outer surface of the major outer surface layer of the transfer tool that are adjacent to the through-hole.

7. The method of claim 1 wherein the through-holes are shaped and sized and the particles are shaped and sized so that each particle does not fully occlude a through-hole into which it is deposited.

8. The method of claim 1 wherein through-holes are shaped and sized and the particles are shaped and sized so that each particle does fully occlude a through-hole into which it is deposited.

9. The method of claim 1 wherein a gap of at least about 1.0 cm is present at the point of closest approach of the major outer surface of the transfer tool and the loose particles on the particle source surface.

10. The method of claim 1 wherein the through-holes are provided in a regular array with an average center-to-center spacing of the through-holes of less than about 200 microns.

11. The method of claim 1 wherein the particles are spherical particles with an average diameter and wherein through-holes are provided in a regular array with an average center-to-center spacing of the through-holes that is less than about 1.4 times the average diameter of the spherical particles.

12. The method of claim 1 wherein the moving transfer tool is an endless belt.

13. The method of claim 1 wherein the moving transfer tool is a roll.

14. The method of claim 1 wherein the loose particles are at least generally spherical.

15. The method of claim 1 wherein the loose particles are made of a material with an inherent density of at least about 2.0 grams/cc.

16. The method of claim 1 wherein the loose particles are glass microspheres.

17. The method of claim 1 wherein the loose particles are abrasive particles.

18. A method of transferring particles onto a moving substrate, the method comprising:

providing a moving transfer tool that travels along an endless tool path and that comprises a major outer surface layer comprising a multiplicity of through-holes in a pre-determined pattern, providing a particle source surface comprising loose particles thereon, wherein the particle source surface is positioned below the transfer tool and proximate a first portion of the tool path so that in the first portion of the tool path there is a gap between the major outer surface layer of the transfer tool and the loose particles on the particle source surface, the gap being at least 0.2 mm at the point of closest approach between the major outer surface of the transfer tool and the loose particles on the particle source surface;

wherein the through-holes are shaped and sized and the particles are shaped and sized so that each particle does not fully occlude a through-hole into which it is deposited;

moving the transfer tool along the tool path so that as a section of the transfer tool traverses the first portion of the tool path, a vacuum applied to the section of the transfer tool in the first portion of the tool path causes at least some particles of the loose particles to traverse, generally vertically upward against the pull of gravity, the gap between the particle source surface and the major outer surface layer of the transfer tool and causes individual particles to be deposited singly upon through-holes of the multiplicity of through-holes of the transfer tool; and, moving the transfer tool further along the tool path so that as the section of the transfer tool bearing particles upon the through-holes thereof enters a second portion of the tool path, the particles are each dislodged from each through-hole and are transferred onto a particle-adherent surface of a moving substrate that is in proximity with the moving transfer tool in the second portion of the tool path, wherein the particles are transferred onto the moving substrate in a pre-determined pattern established by the pre-determined pattern of the multiplicity of through-holes in the major outer surface layer of the transfer tool.

19. A method of transferring particles onto a moving substrate, the method comprising:

providing a moving transfer tool that travels along an endless tool path and that comprises a major outer surface layer comprising a multiplicity of through-holes in a pre-determined pattern, wherein the moving transfer tool is an endless belt;

providing a particle source surface comprising loose particles thereon, wherein the particle source surface is positioned below the transfer tool and proximate a first portion of the tool path so that in the first portion of the tool path there is a gap between the major outer surface layer of the transfer tool and the loose particles on the particle source surface, the gap being at least 0.2 mm at the point of closest approach between the major outer surface of the transfer tool and the loose particles on the particle source surface;

moving the transfer tool along the tool path so that as a section of the transfer tool traverses the first portion of the tool path, a vacuum applied to the section of the transfer tool in the first portion of the tool path causes at least some particles of the loose particles to traverse, generally vertically upward against the pull of gravity, the gap between the particle source surface and the major outer surface layer of the transfer tool and causes individual particles to be deposited singly upon through-holes of the multiplicity of through-holes of the transfer tool; and, moving the transfer tool further along the tool path so that as the section of the transfer tool bearing particles upon the through-holes thereof enters a second portion of the tool path, the particles are each dislodged from each through-hole and are transferred onto a particle-adherent surface of a moving substrate that is in proximity with the moving transfer tool in the second portion of the tool path, wherein the particles are transferred onto the moving substrate in a pre-determined pattern established by the pre-determined pattern of the multiplicity of through-holes in the major outer surface layer of the transfer tool.

* * * * *